United States Patent [19]

Romilly

[11] 3,955,468

[45] May 11, 1976

[54] SIGHTING AND LAYING SYSTEM FOR A MISSILE LAUNCHER

[75] Inventor: Fredrick J. Romilly, Warren, Mich.

[73] Assignee: The United States of America as represented by the Secretary of the Army, Washington, D.C.

[22] Filed: Aug. 6, 1974

[21] Appl. No.: 495,153

[52] U.S. Cl. ..... 89/1.8; 244/3.1

[51] Int. Cl.[2] ..... F41G 3/02

[58] Field of Search ..... 89/1.8, 1.815; 244/3.1, 244/3.16; 73/1 E; 356/152

[56] References Cited

UNITED STATES PATENTS

| | | | |
|---|---|---|---|
| 2,977,858 | 4/1961 | Jasse | 89/41 E |
| 3,328,881 | 7/1967 | Iddings | 73/1 E |
| 3,331,234 | 7/1967 | Eichweber | 73/1 E |
| 3,709,608 | 1/1973 | Degnan et al. | 356/152 |
| 3,797,782 | 2/1974 | Stripling et al. | 244/3.16 |
| 3,851,844 | 12/1974 | Stripling et al. | 244/3.16 |

*Primary Examiner*—Verlin R. Pendegrass
*Assistant Examiner*—S. A. Cangialosi
*Attorney, Agent, or Firm*—Nathan Edelberg; Robert P. Gisbon; Charles R. Carter

[57] ABSTRACT

A sighting and laying system to properly aim the missile gyro axis to a predetermined elevation and to orient this same axis in any desired horizontal direction. These functions are performed without any preleveling of the launcher elevating and slewing mechanism and permits the missile launcher to be located on up to a 6° slope in any direction.

1 Claim, 4 Drawing Figures

SIGHTING AND LAYING SYSTEM FOR A MISSILE LAUNCHER

DEDICATORY CLAUSE

The invention described herein was made in the course of or under a contract or subcontract thereunder with the Government and may be manufactured, used, or licensed by or for the Government for governmental purposes without the payment to me of any royalities thereon.

BACKGROUND OF THE INVENTION

This invention relates to the field of missile laying systems. In such systems involving a large piece of mobile artillery having a long range, accuracy is required to rapidly aim each individual round since target locating rounds cannot be used. Prior systems which use electronically slewable gyros or involve aiming the launcher rail rather than the missile have encountered several problems. The main problems include inadequate accuracy as well as slow reaction time and the need for the launcher to be leveled before aiming.

SUMMARY OF THE INVENTION

The present invention has overcome these problems by using autocollimation techniques to accurately align a theodolite to the missile gyro axis. In practice the axis of the theodolite is autocollimated to the cant axis of the theodolite mounting assembly at the rear of the missile. The theodolite is then autocollimated on a mirror representing the missile gyro axis using azimuth and elevation adjustments on the mounting assembly. These adjustments move the theodolite and cant axis as a unit to adjust both to the missile axis.

This invention may be better understood from the following detailed description taken in conjunction with the accompanying drawing.

DESCRIPTION OF THE PREFERRED EMBODIMENT

Figure 1:
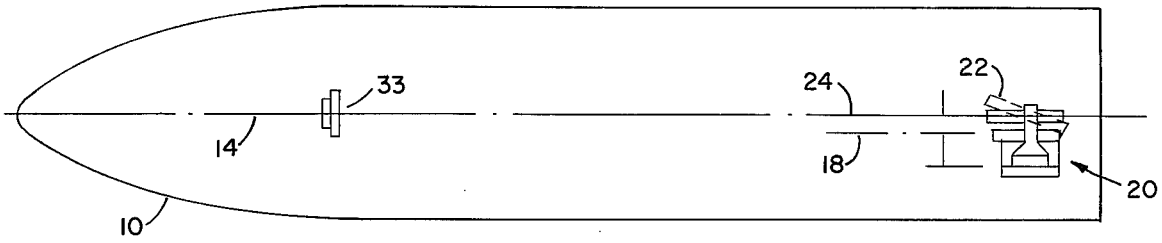
FIG. 1 is a diagrammatic side view of the missile and theodolite.
Figure 2:
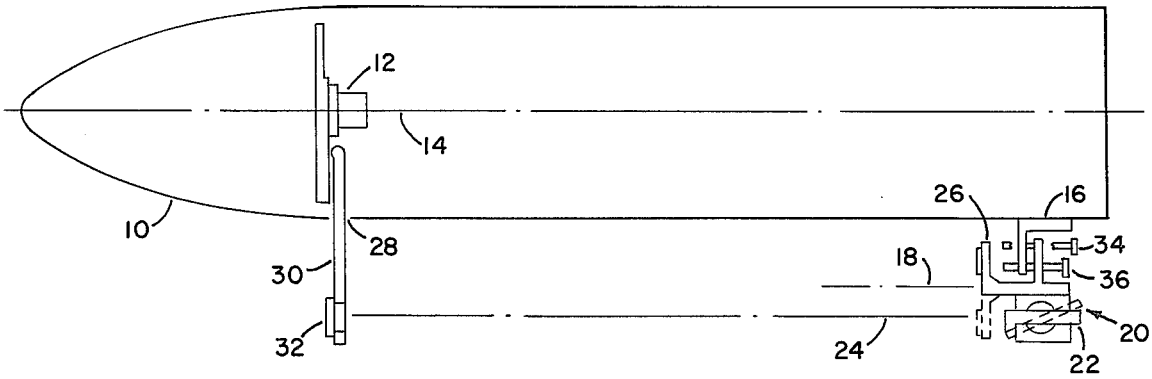
FIG. 2 is a diagrammatic plan view of the missile and theodolite.
Figure 3:
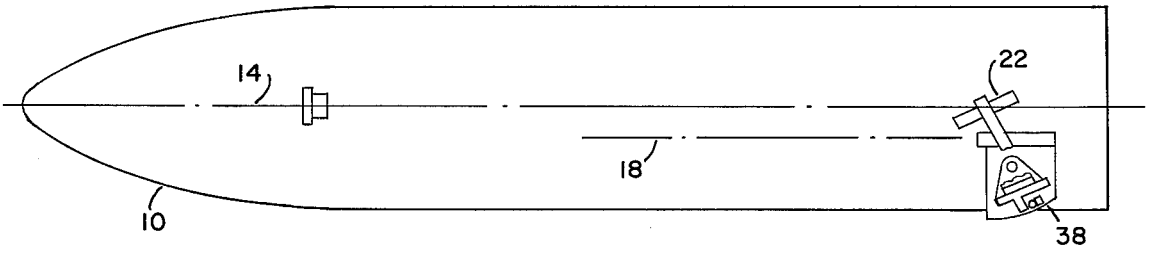
FIG. 3 is a diagrammatic side view of the missile and theodolite set for elevation.
Figure 4:
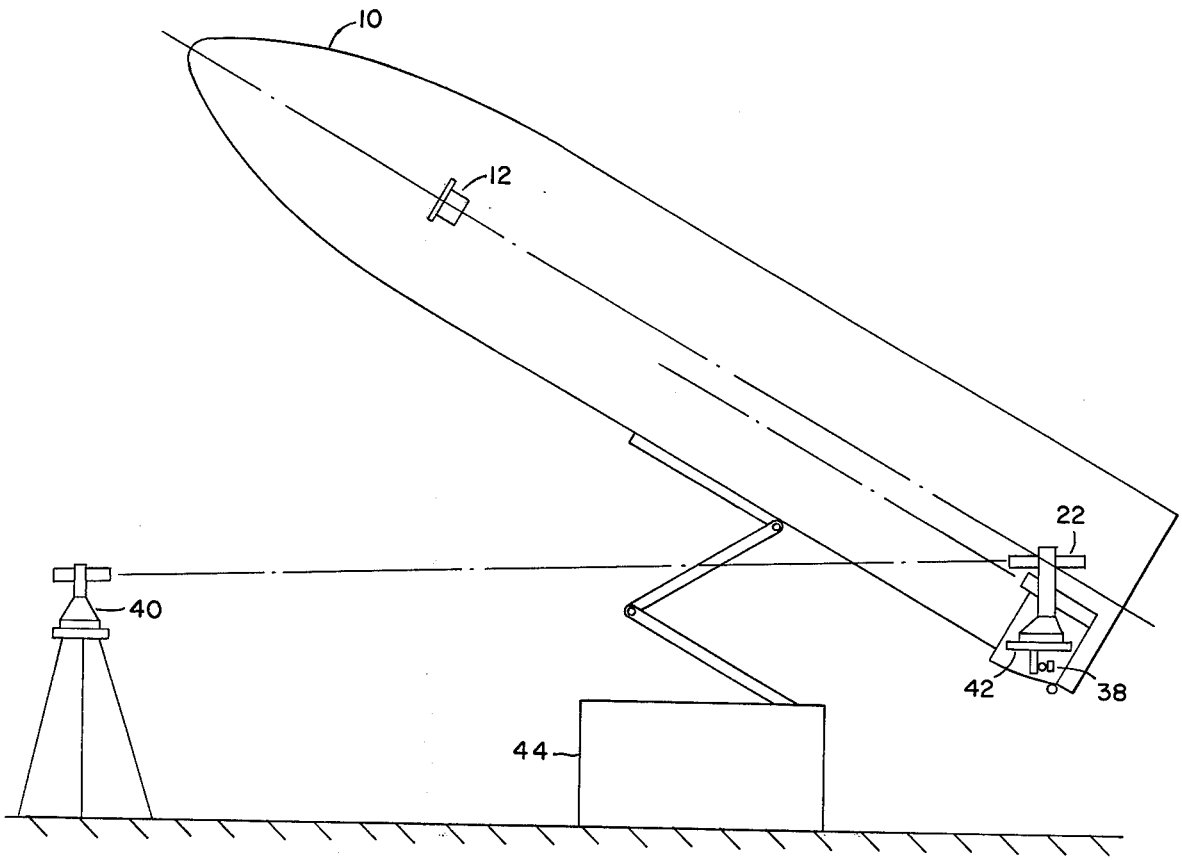
FIG. 4 is a diagrammatic side view of the missile and theodolite after elevation.

Reference numeral 10 indicates a missile having a gyro 12 and a gyro axis 14. A support 16 is removably attached to the rear of the missile and carries to a cant shaft having an axis 18. The cant shaft in turn pivotally supports a rear sight mounting assembly 20 which includes a theodolite 22 having an axis 24. A cant mirror 26 is mounted for rotation on the cant shaft about the cant axis 18. The missile has an opening 28 into which a mirror bracket 30 is inserted for supporting a mirror 32. This mirror when attached to the missile establishes a mirror surface on the forward end of the missile perpendicular to the gyro centerline and a mirror axis 33.

An elevation adjusting screw 34 and an azimuth adjusting screw 36 provide means for moving the theodolite 22 and cant shaft as a unit to adjust both to the missile axis. The mounting assembly includes elevation stops 38, one of which is shown. These stops are placed at fixed elevations with respect to the gyro axis. A remote theodolite 40 is used to align the missile in azimuth prior to actual firing.

In performing the missile sighting and laying process the missile gyro axis 14 is transferred to the aft end of the missile where it is used as a reference with the missile in any position. This is done by establishing a mirror surface on the forward end of the missile perpendicular to the gyro axis. A cant axis 18 is established through the cant shaft and is within the rear mount assembly 20 about which a theodolite is aligned to compensate for the non level attitude of the launcher. The theodolite axis 24 is first aligned to the cant axis 18 by adjusting the theodolite as required to autocollimate on the cant mirror 26. This establishes the theodolite axis parallel to the cant axis. The theodolite axis is locked in this position and the cant mirror 26 is rotated out of the field of view. Locked in this position, the theodolite is now autocollimated on mirror 32 representing the missile gyro axis, using azimuth and elevation adjustment screws 34 and 36. These adjustments move the theodolite and cant shaft as a unit to adjust both to the missile axis. The theodolite is also used to adjust the three elevation stops 38° to 25°, 48° or 54° with respect to the gyro axis when the base is locked against one of the stops and level bubble 42 is centered. To orient the missile gyro axis to the proper azimuth an elevation standard artillery laying techniques are used. Theodolite 22 is sighted on a remote theodolite 40 set up over a presurveyed azimuth reference line. The missile is elevated by conventional means 44.

I claim:

1. A process for sighting and laying a missile and its gyro axis to a predetermined elevation and orient this axis in any desired horizontal direction, comprising:

establishing a cant axis reference in a rear sight mounting assembly about which a theodolite can be aligned to compensate for a non level attitude launcher elevating and orienting mechanism, autocollimating said theodolite on said cant axis to establish the theodolite axis parallel therewith, locking said theodolite in said parallel position, establishing a missile gyro reference on the forward end of said missile, optically transferring said gyro axis to the exterior of said missile, autocollimating said theodolite axis on said gyro axis reference using azimuth and elevation adjustments, setting the azimuth scale of said theodolite to read 0°, rotating said theodolite mounting assembly against selected elevation stops, establishing an elevation reference in said theodolite mounting assembly, elevating said missile to match said elevation references to thus align said missile gyro axis to the selected elevation, and laying the missile in a selected azimuth.

* * * * *